United States Patent [19]

Nielsen et al.

[11] 4,198,840

[45] Apr. 22, 1980

[54] TOOL FOR BENDING METAL PIPES

[76] Inventors: Knud H. Nielsen, Violinvej 12, 3650 Oelstykke; Poul E. K. Carlsen, Lundebjerggaardsvej 304, 2740 Skolvunda, both of Denmark

[21] Appl. No.: 924,774

[22] Filed: Jul. 14, 1978

[51] Int. Cl.[2] ..... B21D 7/024

[52] U.S. Cl. ..... 72/217

[58] Field of Search ..... 72/217, 149, 219, 150

[56] References Cited

U.S. PATENT DOCUMENTS

| | | | |
|---|---|---|---|
| 1,167,983 | 1/1916 | Davis et al. | 72/217 |
| 2,956,609 | 10/1960 | Shaw, Jr. | 72/217 X |
| 3,433,042 | 3/1969 | Crihfield et al. | 72/217 X |
| 4,012,933 | 3/1977 | Porter | 72/217 |

*Primary Examiner*—Milton S. Mehr

*Attorney, Agent, or Firm*—Emory L. Groff, Jr.

[57] ABSTRACT

A tool for bending metal pipes comprises a base member carrying two adjacent mandrels each of which has a semicircular peripheral annular recess for receiving a pipe, one mandrel being mounted on the base member by means of a circular rotatable bearing disc on which the mandrel is eccentrically and rotatably mounted, means being provided for releasably locking the second mandrel in a coaxial relationship with the bearing disc.

9 Claims, 4 Drawing Figures

TOOL FOR BENDING METAL PIPES

BACKGROUND OF THE INVENTION

The invention relates to a tool for bending metal pipes comprising two mandrels adjacently positioned in a base member, said mandrels being rotatable in relation to each other and provided with a semi-circular groove corresponding to the dimensions of the pipe, and furthermore the tool is provided with a clamping member for holding the pipe to be bent.

It is commonly known to bend pipes by means of such a tool by clamping the end of the pipe and placing same between the two mandrels, whereafter one mandrel is guided around the other mandrel in a circumferential motion having a pivotal centre in the centre of said other mandrel.

The disadvantage of the hitherto known tools of this type is that a partial disassembling of the tool has been necessary in order to remove the bent pipe, because the pipe after bending is confined between the grooves of the two mandrels and cannot easily be removed, especially in case of bends of more than 90°. Therefore, it has been necessary either to remove one or both mandrels, in which case it had to be possible to remove the mandrel in a direction radially to the other mandrel.

SUMMARY OF THE INVENTION

It is an object of the present invention to provide a tool of the type mentioned in the introduction in which the above-mentioned disadvantage has been eliminated or reduced.

According to the invention there is provided a tool for bending metal pipes comprising a base member, a first mandrel on said base member defining an annular peripheral recess of semicircular cross-section, a rotatable circular bearing disc mounted on said base member adjacent said first mandrel, a second mandrel rotatably mounted eccentrically on said bearing disc and defining an annular peripheral recess of semicircular cross-section for cooperation with said annular recess of said first mandrel to receive a pipe, and means for releasably locking said second mandrel in a coaxial relationship with said bearing disc.

BRIEF DESCRIPTION OF THE DRAWINGS

The invention will now be described in greater detail, by way of example, with reference to the drawings, in which.

DESCRIPTION OF THE PREFERRED EMBODIMENT

Figure 1:
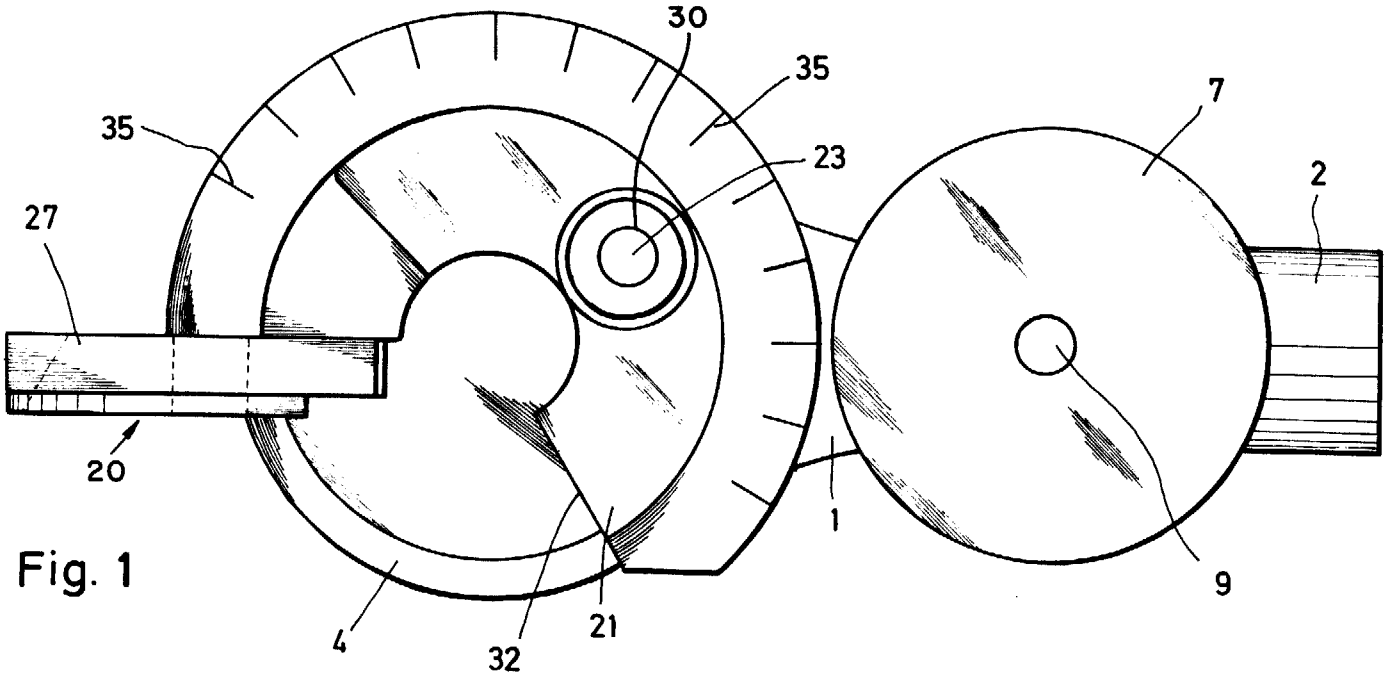
FIG. 1 shows a top plan view of a tool according to the invention.

The tool has a base member 1 with operating means 2 and a bearing part 4. Between the operating part 2 and the bearing part 4 a pair of reinforcing ribs 3 is provided. The bearing part 4 has a cylindrical recess 5 and an open-ended bore 6 also cylindrical. The base member 1 is further provided with an axle journal 9 upon which a mandrel 7 is placed, said mandrel being provided with a circular groove 8. The base member is also provided with a bore 10 for receiving the axle journal 9, if it should be necessary to move the axle journal when other mandrels are used, e.g. another diameter of bending for the pipe to be bent.

Furthermore, the tool has a bearing disc 14 with a connecting part 17. Said disc is rotatably positioned in the recess 5 and the bore 6 respectively. In its lower surface the connecting part 17 is provided with threaded holes. The bearing disc is secured by screws through holes 12 and 13 in a bearing block 11, which is provided with a bar 29 for clamping the tool in a vice. The bearing disc 14 is furthermore provided with an axle journal 23 for another mandrel 21. This axle journal is eccentrically placed on the bearing disc 14, similarly a hole 30 is eccentrically positioned in the mandrel 21.

Figure 2:
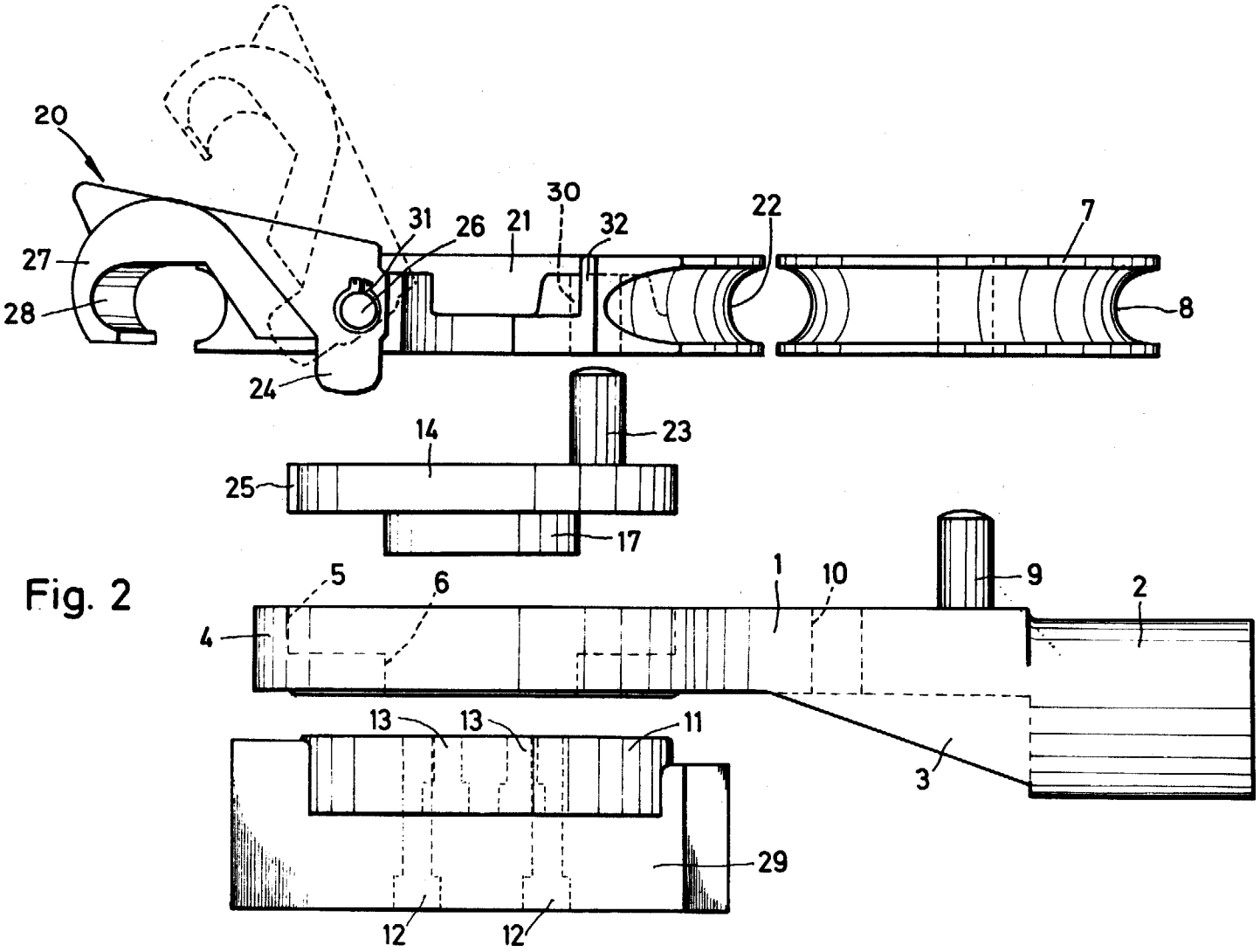
FIG. 2 is an exploded side view of the tool.

However, the mandrel 21 can be locked coaxially to the bearing disc 14. For this purpose the mandrel 21 is made with a radial cut 32 of 120 degrees. One of the end faces thus formed is provided with an axle journal 26 for a locking member 20 which has a latch 24 which can engage a cut-out 25 in the bearing disc 14. As shown in FIG. 2 in dotted lines, the locking member 20 can pivot about the axle journal 26, as a spring retainer 31 secures the locking member 24 on the axle journal 26. When the latch is in locked position the mandrel 21 is concentric with the bearing disc 14. The locking member 20 is further provided with a hook-shaped part 27, the face 28 of which facing the mandrel 21 is semi-circular and corresponds to the size of the pipe to be bent.

Figure 3:
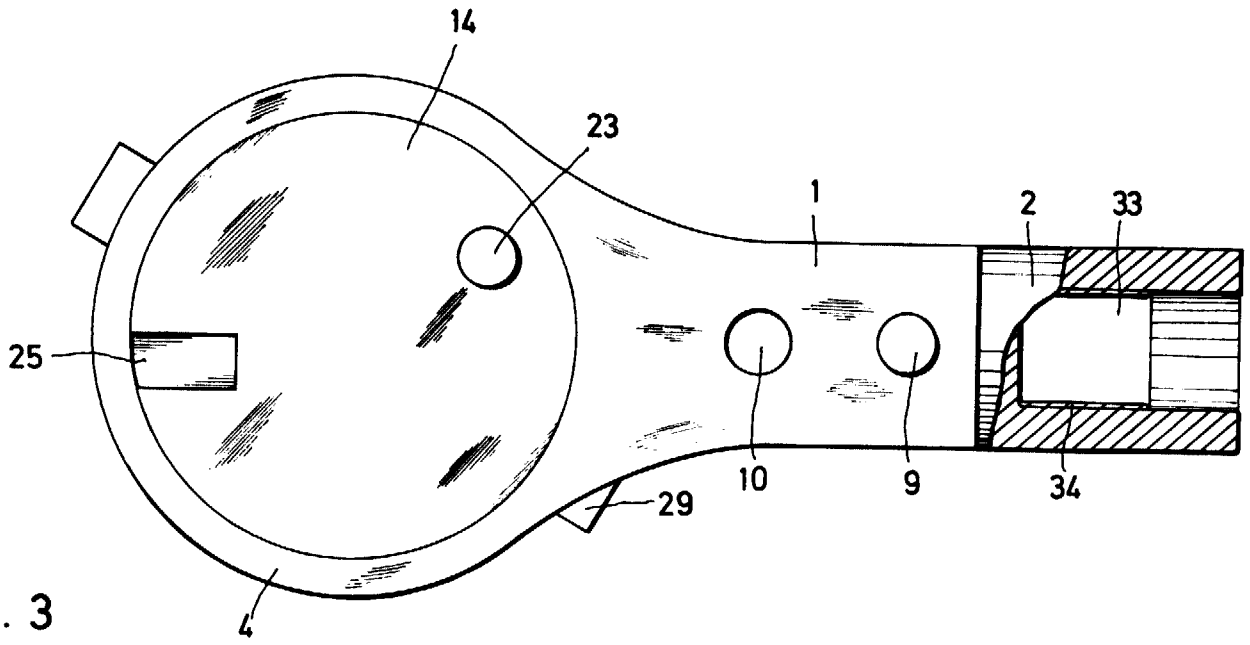
FIG. 3 is a top plan view of the tool with the mandrels removed.

As indicated in FIG. 3, the operating part has a bore 33 with an inner thread 34. In use of the tool, a rod or a tube with a corresponding outer thread may be introduced into said bore 33 in order to facilitate the operation.

The operation of the tool will now be explained referring to FIG. 4.

When a pipe 40 to be bent is introduced into the tool, the hook-shaped part 27 is raised to the position shown in dotted lines in FIG. 2, so that the latch 24 is disengaged from the cut-out 25 in the bearing disc 14. The operating part 2, together with the mandrel 7 is pivoted to a position close to the hook-shaped part 27, whereafter the mandrel 21 can be rotated away from the mandrel 7, as shown in dotted lines in FIG. 4. The pipe 40 is placed in the groove 8 of the mandrel 7, and the mandrel 21 is rotated back towards the pipe 40 and locked by tilting the hook-shaped part 27 downwards, so that the latch 24 again engaged the cut-out 25. Thereby, the hook-shaped part 27 will partly embrace the pipe 40.

A rod inserted in the operating part 2 is pivoted about the mandrel 21, by this, the mandrel 7 rolls on the pipe 40 and bends same around the mandrel 21 in a desired angle, which can be read on a graduated scale 35, see FIG. 1, said scale being provided on the mandrel 21. During this operation, the tool is placed in a vice by means of the bar 29.

Figure 4:
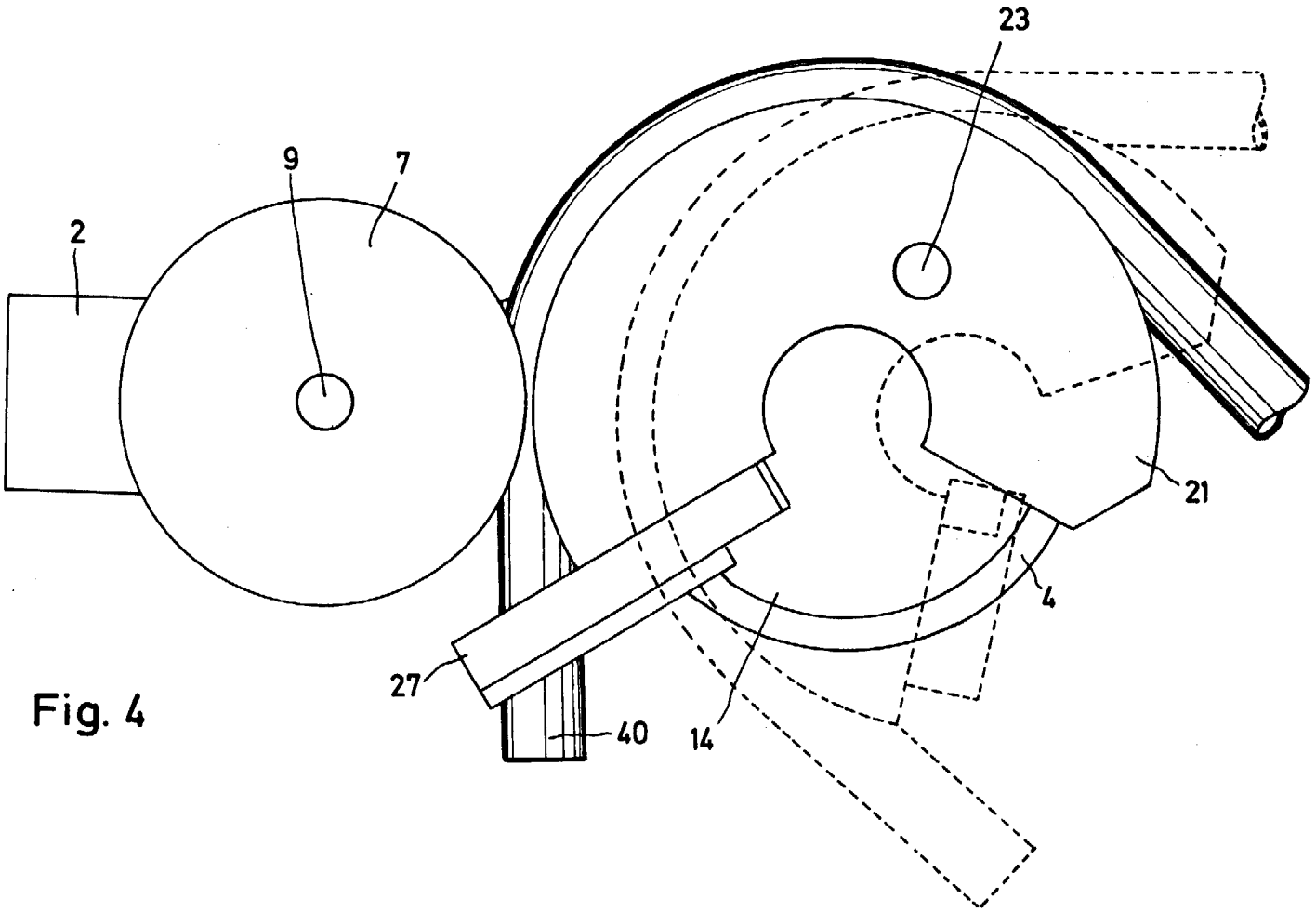
FIG. 4 shows the principle of the operation of the tool.

When the pipe is bent in the desired angle, the operating part 2 is rotated back to the hook-shaped part 27, i.e. to the position shown in FIG. 4. Thereafter, the hook-shaped part 27 is raised so that the latch 24 again disengages the cut-out 25 in the bearing disc 14 so that the hook-shaped part 27 will be released from the pipe 40. In this position, the mandrel 21 together with the pipe 40 is rotated to the position shown in dotted lines in FIG. 4, and thereafter the pipe can easily be removed.

It will be understood that the above description of the present invention is susceptible to various modification changes and adaptations.

I claim:

1. A tool for bending metal pipes comprising a base member, a first mandrel on said base member defining an annular peripheral recess of semi-circular cross section, a rotatable circular bearing disc mounted said base member adjacent said first mandrel, a second mandrel, rotatably mounted eccentrically on said bearing disc and defining an annular peripheral recess of said first mandrel to receive a pipe, means for releasable locking said second mandrel in a coaxial relationship with said bearing disc and retaining means on said locking means for retaining a pipe in said tool.

2. A tool as defined in claim 1, wherein said bearing disc is located in a recess in said base member.

3. A tool as defined in claim 2, wherein said locking means comprises a latch element pivotally mounted on one face of a radial cut out defined by said second mandrel for pivotal engagement with a cut out defined by said bearing disc.

4. A tool as claimed in claim 3, wherein said radial cut out of said second mandrel extends peripherally for 120°.

5. A tool as defined in claim 3, wherein said pipe retaining means comprises a hook shaped part of said locking means for engagement with a pipe when said locking means is locked.

6. A tool as defined in claim 5, wherein a surface of said hook shaped part for facing a pipe comprises a generally cylindrical surface extending parallel to a tangent to said second mandrel.

7. A tool as defined in claim 1, and comprising a bearing block located in an opposite side of said base member to said bearing disc for securing said bearing disc to said base member.

8. A tool as defined in claim 7, and comprising a bar on said bearing block for enabling clamping of said tool in a vice.

9. A tool as defined in claim 7, wherein said bearing block is secured to said bearing disc by screws.

* * * * *